United States Patent [19]

Wallis

[11] 4,332,179

[45] Jun. 1, 1982

[54] COMBINED PUNCH RETAINER AND FLUID-ACTUATED STRIPPER

[76] Inventor: Bernard J. Wallis, 25200 Trowbridge Ave., Dearborn, Mich. 48124

[21] Appl. No.: 194,996

[22] Filed: Oct. 8, 1980

[51] Int. Cl.[3] ..... B21D 45/08

[52] U.S. Cl. ..... 83/137; 83/169; 83/698

[58] Field of Search ..... 83/137, 169, 698

[56] References Cited

U.S. PATENT DOCUMENTS

| | | | |
|---|---|---|---|
| 1,979,059 | 10/1934 | Wallman | 279/77 |
| 2,215,015 | 9/1940 | Richard | 279/1 K |
| 3,119,292 | 1/1964 | Schmid | 83/137 X |
| 3,245,694 | 4/1966 | Parker | 83/698 X |
| 3,518,908 | 7/1970 | Daniels | 83/137 |
| 3,564,959 | 2/1971 | Harada | 83/137 X |
| 3,566,730 | 3/1971 | Pancook | 83/137 |

*Primary Examiner*—James M. Meister

*Attorney, Agent, or Firm*—Barnes, Kisselle, Raisch & Choate

[57] ABSTRACT

A vertically oriented cylinder has a punch retainer firmly secured to its lower end. The piston within the cylinder has several legs which extend downwardly through and below the retainer. A stripper plate secured to the lower ends of the legs of the piston is biased downwardly by the fluid pressure in the cylinder chamber above the piston which is connected to a fluid pressure source.

2 Claims, 5 Drawing Figures

COMBINED PUNCH RETAINER AND FLUID-ACTUATED STRIPPER

This invention relates to a combined punch retainer and fluid-actuated stripper for use on punch presses.

It is an object of this invention to provide a combined punch retainer and fluid-actuated stripper in the form of a unitary assembly which enables removal and replacement of a punch without disconnecting the fluid system or relieving the fluid pressure therein.

Another object of this invention is to provide a combined punch retainer and fluid-actuated stripper of economical and rigid construction and which can be readily serviced.

More specifically, the invention contemplates a unitary assembly of a punch retainer and fluid-actuated stripper which can be mounted directly on the upper shoe of a die assembly. The assembly consists essentially of a rigidly constructed cylinder, the upper end of which is connected with a pressure source such as a nitrogen accumulator which biases a piston in the cylinder to a lowermost position. A stripper plate is connected directly to the piston and surrounds the lower end of the punch. The upper end of the punch is removably seated in a retainer firmly secured to the lower end of the cylinder above the stripper plate.

Other objects, features and advantages of the present invention will become apparent from the following description and accompanying drawings, in which.

Figure 3:
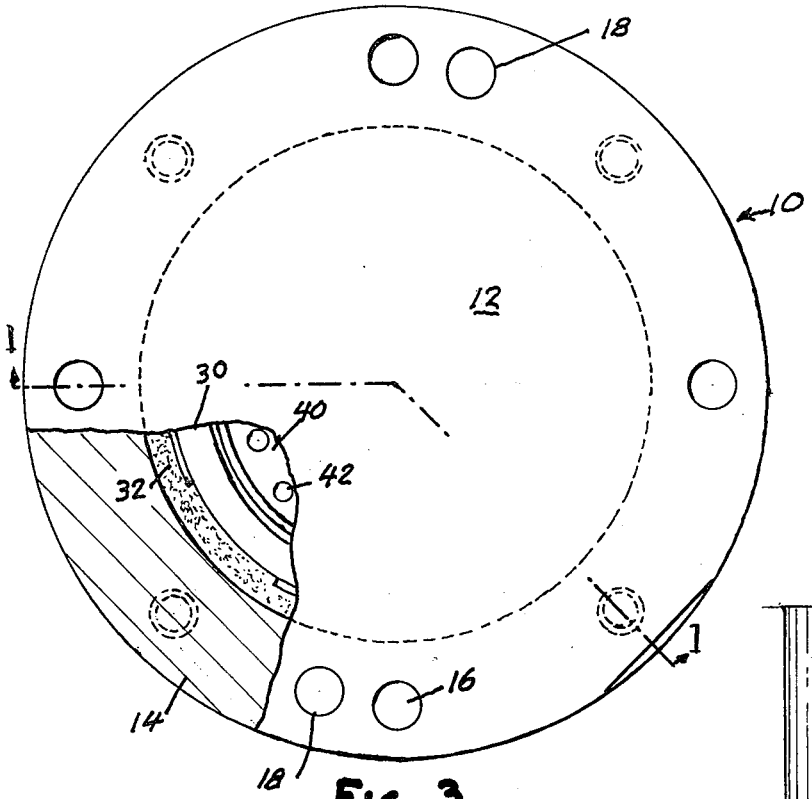
FIG. 3 is a top plan view, partly in section, of the device.
Figure 2:
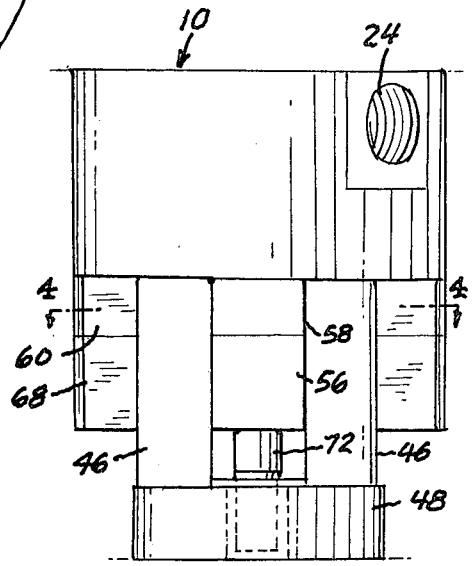
FIG. 2 is a side elevational view of the device.

Referring to the drawings, the combined punch retainer and fluid-actuated stripper of the present invention comprises a cylinder 10 having a top wall 12, and a side wall 14. Cylinder 10 is adapted to be mounted against the bottom face of the upper shoe 15 of a die assembly by means of a plurality of screws 16 and accurately positioned on shoe 15 by a plurality of dowel pins 18 (FIG. 3). The cylinder is formed with a bore 20 in which a piston, generally designated 22, is adapted to reciprocate vertically. The upper end of bore 20 is connected by a port 24 and a conduit 26 to an accumulator 28 containing a gas (preferably nitrogen) at a relatively higher pressure. The pressure of the gas in accumulator 28 normally biases piston 22 downwardly to the position shown in FIG. 1.

Figure 4:
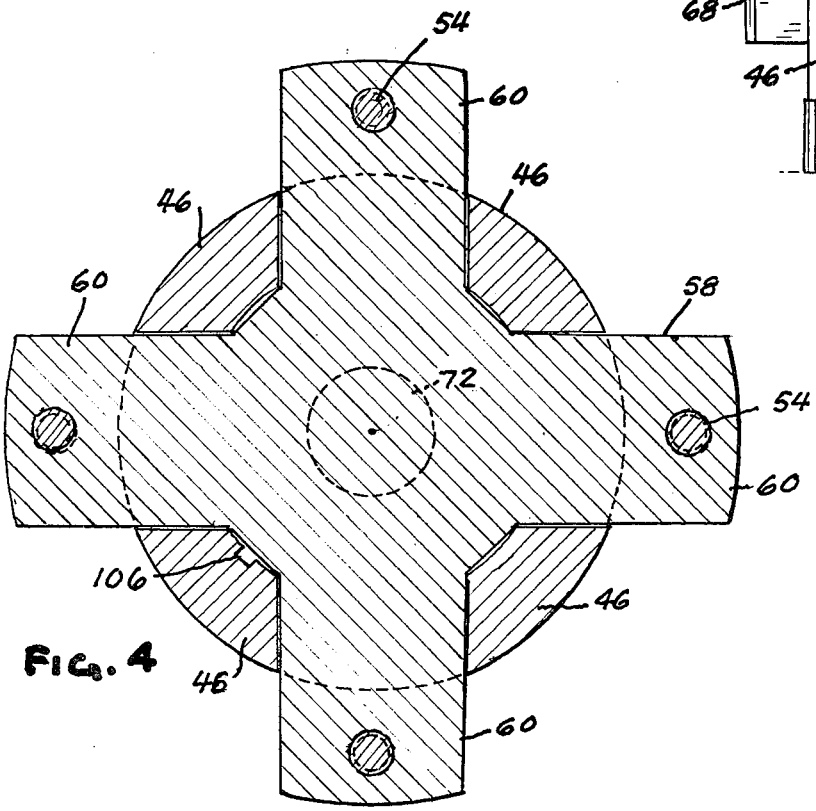
FIG. 4 is a sectional view taken along the line 4—4 in FIG. 2.

Piston 22 has a head 30 at its upper end which is sealed in the bore 20 by an annular seal 32 and is guided for vertical reciprocation within bore 20 by a hard fiber bearing 34. The top face of head 30 is formed with a cavity 36 in which an oil-filled sponge 38 is retained by an orifice plate 40 containing a plurality of apertures 42. A plurality of radial passageways 44 extend outwardly from cavity 36 to the outer periphery of head 30 to the portion thereof embraced by annular bearing 34. Four legs 46 extend downwardly from around the periphery of head 30. As shown in FIG. 4, the four legs 46 are equally spaced circumferentially around the piston. A stripper plate 48 is secured by screws 50 to the lower ends of legs 46.

A punch retainer, generally designated 52, is secured by screws 54 to the lower end of the side wall 14 of cylinder 10. Retainer 52 comprises a lower punch receiving plate 56 and an upper punch backing plate 58. Each of these plates is of cruciform shape when viewed in plan as is best shown in FIG. 4. Backing plate 58 has four radially outwardly extending legs 60 which straddle the legs 46 of piston 22 and through which the screws 54 extend. The bottom face of backing plate 58 has a flat central portion 62 in coplanar engagement with the flat central portion of the top face of punch receiving plate 56. The central portion of the top face of backing plate 58 is upwardly convex as indicated at 64 so that the central portion of the backing plate is considerably thicker than the outer peripheral portion thereof. The bottom face of the head 30 of piston 22 is concave as indicated at 66 to conform generally in contour with the convex portion 64 of backing plate 58.

The punch receiving plate 56 is likewise provided with four radially outwardly extending legs 68 which are vertically juxtaposed to the legs 60 of backing plate 58. The legs 68 also straddle the downwardly extending legs 46 of piston 22. Punch receiving plate 56 is formed with a central through bore 70 sized to have a close fit with the shank of a punch 72. The upper end of punch 72 bottoms against the lower face 62 of the backing plate 58. Punch 72 is releasably retained within bore 70 by a wedging roller assembly generally designated 74. This retainer arrangement is substantially identical in construction and operation with that shown and described in my copending application Ser. No. 06/177,117, filed Aug. 11, 1980. Generally speaking, the retainer assembly 74 includes a roller 76 mounted on a clip 78 which is biased downwardly by a spring 80 so that the roller 76 is normally urged into wedging relation with an inclined surface 82 on the punch and a converging surface 84 in the receiving plate 56.

When it is desired to replace the punch 72 a tool 86 is threaded upwardly into an inclined threaded socket 88 in the punch receiving plate 56 so that the leading upper end of the tool engages and lifts roller 76 sufficiently to clear and permit retraction of the punch and replacement with another punch.

The stripper plate 48 has an inclined passageway 90 therein aligned with socket 88 to accommodate the tool 86 from below the assembly. Stripper plate 48 also has a central bore 92 therein through which the leading end of the punch 72 extends. The lower die shoe 94 has a die bushing 96 located thereon which is accurately aligned with and sized to receive the leading end 98 of the punch.

Figure 1:
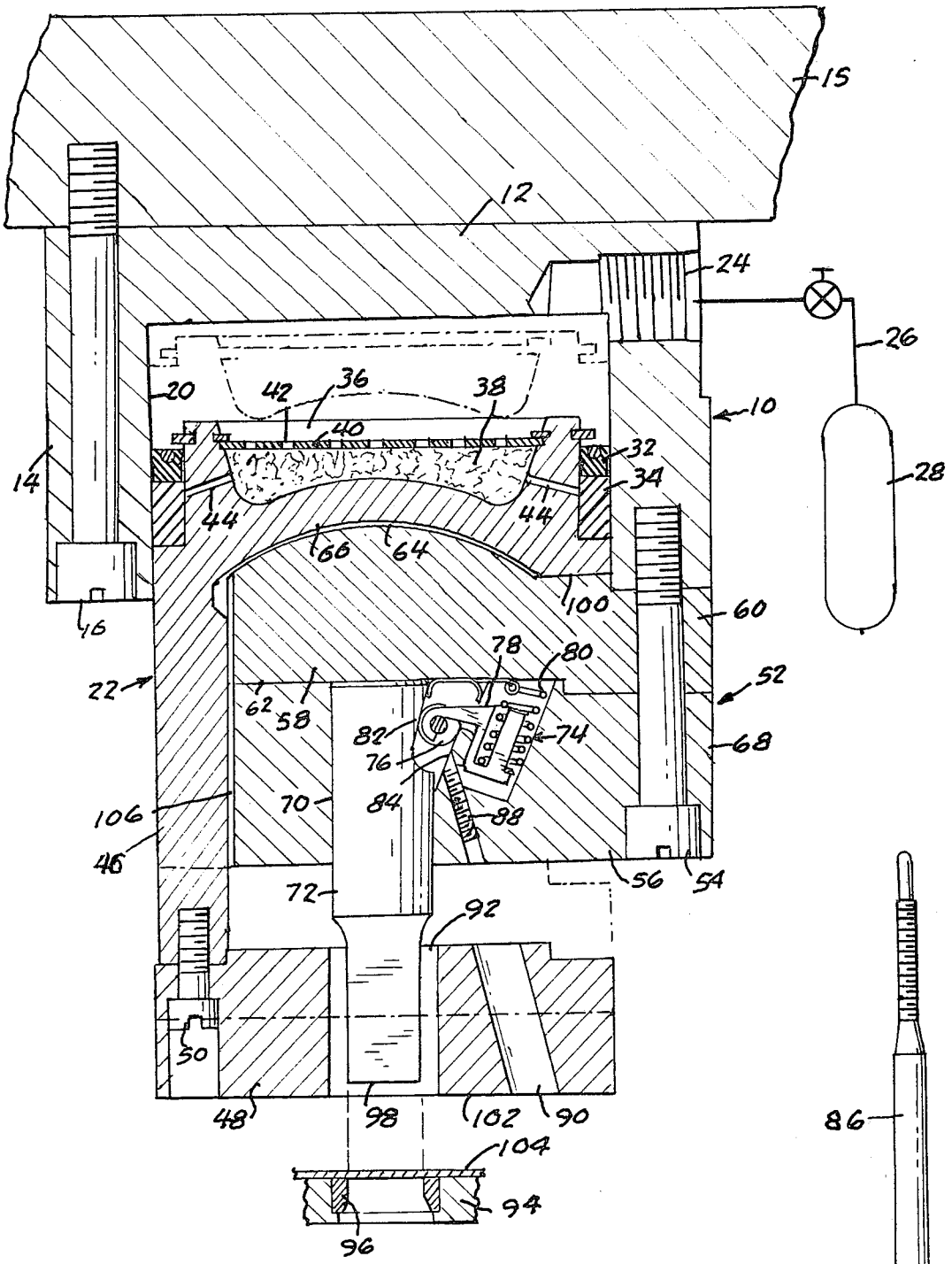
FIG. 1 is a vertical sectional view of a combined punch retainer and fluid-actuated stripper according to the present invention taken along the line 1—1 in FIG. 3.
Figure 5:
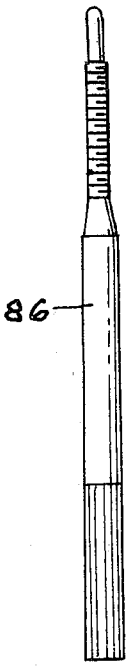
FIG. 5 is an elevational view of the tool employed for replacing the punch in the retainer.

As shown in FIG. 1, when the upper die shoe 15 is in the raised position, piston 22 is biased downwardly to its lowermost position wherein it bottoms against the flat portion 100 of backing plate 58. At this time, the leading end 98 of punch 72 is spaced at least slightly above the flat bottom face 102 of stripper plate 48.

When the upper die shoe 15 is driven downwardly the stripper plate 48 will be displaced downwardly with cylinder 10 until it contacts the workpiece 104 on the lower die shoe 94. After stripper plate 48 contacts the workpiece further downward movement of the upper die shoe 15 will cause the punch 72 to penetrate through the workpiece and, thus, punch a hole therein. At the same time, since cylinder 10 is being displaced downwardly, piston 22 will be moving relatively upwardly in the bore 20 of the cylinder against the bias of the fluid pressure produced by the accumulator 28. After the punch has penetrated through the workpiece and the upper die shoe 15 is retracted upwardly, stripper plate 48 will remain in pressure engagement with the top face of the workpiece until the flat portion 100 of backing plate 58 moves upwardly into abutting engagement with the under side of the piston at which time the piston will move upwardly with cylinder 10 to the position shown in FIG. 1.

If it should become necessary to replace the punch, this can easily be accomplished by inserting tool 86 upwardly through passageway 90 and threading it into socket 88 so that the leading end of the tool engages and displaces roller 76 upwardly and to the right until it clears the upper end of the punch. The punch can then be retracted from within bore 70. It will be noted that the punch can thus be replaced without disconnecting the fluid system or even relieving the pressure in the cylinder chamber above piston 22. It will also be appreciated that as piston 22 reciprocates in cylinder 10 the pressure fluid above the piston acting on the oil-filled sponge 38 will cause lubricant to flow radially outwardly through passageways 44 and thus lubricate bearings 34 and the bore of the cylinder. The space between the bottom side of piston head 30 and the top side of backing plate 58 communicates with atmosphere through a passageway 106.

I claim:

1. A combined punch retainer and fluid-actuated stripper comprising a fluid cylinder adapted to be mounted on a vertically reciprocating die member for movement therewith, said cylinder having a vertical bore therein, said bore being open at its lower end and having an inlet port adjacent its upper end, a piston arranged for vertical reciprocation in said bore, a punch retainer at the lower open end of said cylinder, said punch retainer having a plurality of circumferentially spaced, radially outwardly extending fingers, the outer ends of which register circumferentially with the lower end of said cylinder, screws extending upwardly through the outer ends of said fingers and into the lower end of the cylinder and fixedly securing the punch retainer on the lower end of the cylinder, said piston having a plurality of integrally formed legs thereon extending downwardly between and beyond the radially extending fingers on the punch retainer, said punch retainer having a downwardly opening bore therein for receiving a punch, a stripper plate transversely spanning the lower ends of said legs and having an opening therein for accommodating said punch and screws extending upwardly through the outer peripheral portion of said stripper plate and into the lower ends of said legs for fixedly mounting the stripper plate on said legs, said fingers and legs being interengaged to prevent relative rotation between the stripper plate and the punch.

2. The combination set forth in claim 1 wherein said retainer comprises a punch backing plate having a flat bottom face and a punch receiving plate seated against the bottom face of the backing plate, said punch bore extending vertically through said receiving plate so that the upper end of the punch abuts the bottom face of the backing plate, the upper face of said backing plate being upwardly convex throughout a substantial portion of the cross sectional area of the piston so that the central portion of the backing plate is substantially thicker than the outer peripheral portion thereof, the bottom face of said piston being upwardly concave to accommodate the upwardly convex central portion at the top face of the backing plate when the piston is at the lower end of the cylinder.

* * * * *